US008192297B1

(12) United States Patent
Johnston et al.

(10) Patent No.: US 8,192,297 B1
(45) Date of Patent: Jun. 5, 2012

(54) VARIABLE INTERFACE PUTTER GOLF CLUB WITH ATTACHABLE DEVICE FOR ANALYZING GOLF COURSE CONDITIONS AND SELECTING PUTTER FACE

(76) Inventors: Douglas F. Johnston, Huntington, NY (US); Beth Johnston Perchuk, Hampton Bays, NY (US); Eric Koenig, Huntington, NY (US)

( * ) Notice: Subject to any disclaimer, the term of this patent is extended or adjusted under 35 U.S.C. 154(b) by 3 days.

(21) Appl. No.: 12/729,170

(22) Filed: Mar. 22, 2010

Related U.S. Application Data

(60) Provisional application No. 61/162,200, filed on Mar. 20, 2009.

(51) Int. Cl.
*A63B 69/36* (2006.01)
*A63B 53/04* (2006.01)

(52) U.S. Cl. ..... 473/251; 473/244; 473/325

(58) Field of Classification Search ..... 473/219, 473/221, 222, 223, 226, 244–248, 251, 313, 473/324–350, 407
See application file for complete search history.

(56) References Cited

U.S. PATENT DOCUMENTS 4,618,149 A * 10/1986 Maxel ..... 473/245
5,294,110 A * 3/1994 Jenkins et al. ..... 473/407
6,059,672 A * 5/2000 Zeiner-Gundersen ..... 473/407
6,863,620 B2 * 3/2005 Tucker, Sr. ..... 473/288
7,118,498 B2 * 10/2006 Meadows et al. ..... 473/407
7,442,129 B2 * 10/2008 Bardha ..... 473/251
2007/0161430 A1 * 7/2007 Bardha ..... 473/244
2010/0113177 A1 * 5/2010 Bardha ..... 473/325

* cited by examiner

*Primary Examiner* — Nini Legesse
(74) *Attorney, Agent, or Firm* — Edwin D. Schindler

(57) ABSTRACT

A variable interface putter golf club includes a golf club having a shaft with a club head affixed to a first end of the shaft that is distil from a second end of the shaft to be gripped by a golfer. A multi-sided rotatable carousel is contained substantially within the club head of the golf club, the multi-sided rotatable carousel having a putter face on a plurality of sides of the multi-sided rotating carousel. The multi-side rotating carousel preferably is shaped as a pentagon with a different putter face on each of the five sides of the pentagon. A device is included for permitting rotation of the multi-sided rotatable carousel for exposing one putter face of the plurality of putter faces at a given time for allowing the golfer to putt with the one putter face so exposed. A securing device, such as a securing screw, is used for preventing unwanted rotation of the multi-sided rotatable carousel so that only one putter face is exposed at a given time and that the selected putter face is secured in place during play. An optional analyzer device is included which aids the golfer in selecting the appropriate putter face for the conditions of a putter green at a given time. The optional analyzer device may also be used for other types of golf clubs and attached to portion of a golf club other than the shaft.

17 Claims, 5 Drawing Sheets

VARIABLE INTERFACE PUTTER GOLF CLUB WITH ATTACHABLE DEVICE FOR ANALYZING GOLF COURSE CONDITIONS AND SELECTING PUTTER FACE

CROSS-REFERENCE TO PROVISIONAL PATENT APPLICATION

Domestic priority is hereby claimed, pursuant to 35 U.S.C. §119(e), from U.S. Patent Provisional Application No. 61/162,200, filed Mar. 20, 2009, the entire disclosure of which shall be deemed to be incorporated by reference herein.

BACKGROUND OF THE INVENTION

1. Technical Field of the Invention

The present invention relates, generally, to a variable interface putter golf club which may be used in combination with an attachable device for allowing a golfer to analyze golf course conditions and select the most appropriate putter face for the environment conditions then existing on the golf course or, more particularly, the putting green.

More particularly, the present invention relates to a variable interface putter golf club that includes a plurality of independent putting faces attached to the side of a self-contained rotating carousel, or revolving track, that enables the golfer to readily change the putter surface, or putter face, of the golf putter club for providing the golfer with the optimal putter face for the particular conditions of the green on the day of play.

In order to aid the golfer in selecting the optimal putter face, means for analyzing atmospheric and green conditions are attachable to the golf putter, as well as means for permitting the proper orientation of the putter to the golf hole, adjusting the putter to the proper face angle vis-à-vis the golf ball, and subsequently adjusting the tempo, rhythm and cadence of the golfer's stroke for aiding the golfer in putting more accurately.

2. Description of the Prior Art

Even a scratch golfer minimally putts, on average, at least twice per hole or 36 times per round of golf. Most golfers putt even more often. When putting, golfers need to take into account the speed and slope of the putting green, the proper face angle of the putter and the alignment of the putter to the hole. With such numerous and rather complex factors to be considered, the result is often a lack of confidence and wasted strokes.

The prior art includes numerous types of aids to assist the golfer in achieving an improvement in his or her play. Illustrative of such play enhancing devices is a personal golfing assistant system taught by Meadows et al. U.S. Pat. No. 7,118,498, issued Oct. 10, 2006, which includes a hand-held device having a GPS receiver that enables the user to survey and/or electronically capture "geophysical" golf data, including permitting the golfer to make adjustments for optimal performance and to compensate for environmental conditions.

Chang et al., P.C.T. International Application Publication No. WO 2005/079933 A1, published Sep. 1, 2005; and Smith, U.S. Pat. No. 5,431,401, issued Jul. 11, 1995, generally teach golf putter alignment, or orientation, devices.

Howard et al., U.S. Pat. No. 6,729,965, issued May 4, 2004, discloses a golf practice device having a "turntable" which provides a quantity of balls for the practice device thereof, but is not directed to a turntable or rotating carousal for presenting one of a plurality of putter faces for a golf putter.

The prior art, however, fails to teach or suggest a golf putter that has a plurality of available putter faces, any one of which can be selected on the basis of the condition for the green and surrounding environmental conditions for permitting the player to achieve his or her optimal performance under the existing conditions of the golf green.

SUMMARY OF THE INVENTION

It is, therefore, an object of the present invention to provide a variable interface putter golf club with an attachable device for analyzing golf course conditions, which allows a golfer to select among a plurality of putter faces, the most appropriate putter face, taking into consideration environmental and green conditions, or, in the alternative, the golfer may select the appropriate putter face on the basis of the golfer's instinct and experience.

It is an additional object of the present invention to provide a variable interface putter golf club with an attachable device for analyzing golf course conditions, whereby the putter conforms to recognized rules of the game of golf, yet permits the golfer to maximize his or her performance of play by selecting the optimal putter face for any given playing conditions.

It is, yet, a further object of the present invention to provide a variable interface putter golf club with an attachable device for analyzing golf course conditions which overcomes the drawbacks inherent in prior art golf putters.

The foregoing and related objects are achieved by the variable interface putter golf club of the present invention, which includes a plurality of independent putting faces, each putting face attached to one side of a multi-sided, self-contained rotating carousel, or similar revolving track, located at the end of a golf putter golf club distal to the end of the golf putter held by a golfer. The golfer can easily rotate the multi-sided carousel, for example, manually, to move the desired putter face into position so that the selected putter face will strike the golf ball when the golfer putts. The selected putter face is secured, or locked, into position, so that it cannot freely rotate during play, via a screw or a frictional device that prevents unwanted rotation of the multi-sided carousel.

Each putting face located on one of the sides of the multi-sided carousel is preferably made of a different material, so that the individual putting faces are of different densities and textures in order to compensate for, or counterbalance, various green speeds. Alternatively, or in addition, the plurality of putter faces may be multi-layered to be multi-density and may, optionally, include impact control wafers. The putting faces also provide for an anti-torque effect.

Putter faces that are to have multiple layers may, in a preferred embodiment, have a "texture" layer, which would be the face or outer layer; a "shock absorber" layer, which would be a middle layer; and a "stability/refraction" layer, which would be the innermost layer of a given putter face.

The variable interface putter face apparatus includes a multi-sided, self-contained rotating carousel 18, located within the club head, which may be comprised of three or more sides—each side supporting one putter face—however, five sides, or a pentagon-shaped rotating carousel is preferred, since this shape for the carousel is understood to provide the best moment of inertia. The preferred pentagon shape of the rotating carousel has been discovered to create greater stabilization at impact with the golf ball due to the higher moment of inertia, which produces a greater transfer of energy for a straighter ball path.

In order to aid the golfer in selecting the putter face that would be optimal under the atmospheric and surface conditions of the putting green, the present invention further includes a device that is attachable to the shaft or head of the golf putter, such as via a clamp, clasp, fastener, grapple, clench or similar securing means. The device that is attachable to the golf putter for analyzing environmental conditions and thereby selecting the most appropriate putter face is intended for use on a practice green and during non-competitive rounds of golf, though use of such a device during practice, it is anticipated, would allow the golfer to more intelligently select a putter face that is most appropriate on his or her own during competitive play, even without concurrent use of such analysis device.

The device for analyzing environmental conditions of the putting green for aiding in the selection of the optimal putting face is intended to have two modes: (1) a "selection" mode and (2) a "calibration" mode, along with a data tracking ball. In the selection mode, the analysis device methodically analyzes and examines the various atmospheric, climatic and environmental conditions present on a particular practice green, thereby assessing and evaluating the speed of the green at that moment in time. The analysis device is then able to display a recommendation on a display face plate as to which of the putter faces of the variable interface putter golf club is best suited for the conditions presented by the putting green at the particular time. In the calibration mode, the analyzing device is utilized to properly orient the golf putter to the golf hole; to adjust the putter to the proper face angle to the ball; and to then adjust the tempo, rhythm and cadence of the golfer's stroke, so that the golfer may putt more accurately.

More particularly, in the "selection" mode, the analysis device is set or placed, preferably via pivoting, into its downward position, so that the data tracking ball or comparable means for reading the greens, at the end of the analysis device makes contact with the surface of the green. The golfer would then take a series of practice swings with the golf putter, so that the data tracking ball would roll along the green. This is done in order to determine green speed (via an electronic stimpmeter or similar device) and to detect local atmospheric, climatic and environmental conditions via internal monitoring technology. Such climatic monitoring technology is widely available and which may be obtained, for example, from Omega Engineering, Inc. of Stamford, Conn.

An internal microprocessor is provided for the analysis device, which then accumulates and analyzes the obtained environmental and climatic readings of the putting green, following which such information is displayed on a digital screen of the analyzing device. Such information displayed should preferably include temperature, humidity and the recorded green speed, along with a recommendation of the type of putter face that should optimally be used. The software for the microprocessor should associate the recommended type of putter face with a letter or number designation matching one of the putter faces contained within the multi-sided carousel which contains a plurality of putter faces. Most preferably, the microprocessor of the analyzing device should also make a recommendation of adjustable weight on the basis of all available information, in addition to other such relevant aspects which might contribute to overall game performance.

Regarding the specificity of the calibration mode of the analysis device, once the golfer has selected which putting face to use, the analyzing device is flipped upward, or pivoted, from its prior downward position to, preferably, a horizontal position to activate its calibration mode. Instead of providing for activation of the calibration mode upon pivoting the analyzing device from the downward position to a horizontal, upward or raised position, separate activation means, such as an "on/off" switch, may be provided. Upon activation of the calibration mode, the display screen of the analyzing device provides a so-called "calibration screen" for conveying additional information to the golfer.

Once the calibration mode is activated and the golfer has selected which putter face to use, the golfer then places the variable interface golf putter head adjacent to the golf hole, so that an alignment strip, located down the center of the club head and perpendicular to the face of the putter, is directed at the center of the golf hole. The golfer then sets the baseline coordinates for the golf hole by depressing, clicking or otherwise interacting with the data tracking ball of the analyzing device, which data tracking ball also functions as a selection toggle or switch. A housing for the data tracking ball may function as the toggle, rather than the tracking ball itself. Alternatively, there may be an "on/off" switch, toggle or activation button located elsewhere on the analyzing device that serves the same purpose.

Once baseline coordinates for the golf ball are set, and an internal coordinate guidance and compass system is activated, the golfer can walk anywhere on the putting green in a 360°—radius around the golf hole and the analyzing device will calculate and thereby "know" the direction to the hole via its internal compass system. The digital display will indicate to the golfer, in degrees relative to the golf hole, just how far off-center the putter face is with respect to a straight line to the golf hole.

In the calibration mode, the analyzing device will further indicate the proper face angle of 90° to the golf ball. This is achieved via an internal electronic level, which will give off an audible or visual alert if the putter face of the golf club is not at the preferred 90° angle. The golfer can, in a preferred embodiment, also choose to set the rhythm and cadence of his or her putting stroke via an internal metronome, which can be set to click, tick, beep, flash or otherwise provide an audible or visual signal noticeable by the golfer for allowing the golfer to properly sync the timing of his or her backstroke and follow-through.

Finally, an alignment jig is used to properly align the analyzing device with the variable interface putter golf club prior to use of the analyzing device. While a wide array of possible alignment devices could be utilized, in the preferred embodiment to be shown and described hereinafter, the alignment jig may be snapped, or otherwise secured, to the face of the variable interface putter golf club and to the rear of the analyzing device. The alignment jig may also be configured to be attachable to other locations as between the variable interface putter golf club and the analyzing device.

Other objects and features of the present invention will become apparent when considered in combination with the accompanying drawing figures which illustrate certain preferred embodiments of the present invention. It should, however, be noted that the accompanying drawing figures are intended to illustrate only certain embodiments of the claimed invention and are not intended as a means for defining the limits and scope of the invention.

BRIEF DESCRIPTION OF THE DRAWING FIGURES

In the drawing, wherein similar reference numerals and symbols denote similar features throughout the several views.

DETAILED DESCRIPTION OF THE DRAWING FIGURES AND PREFERRED EMBODIMENTS

Figure 1:
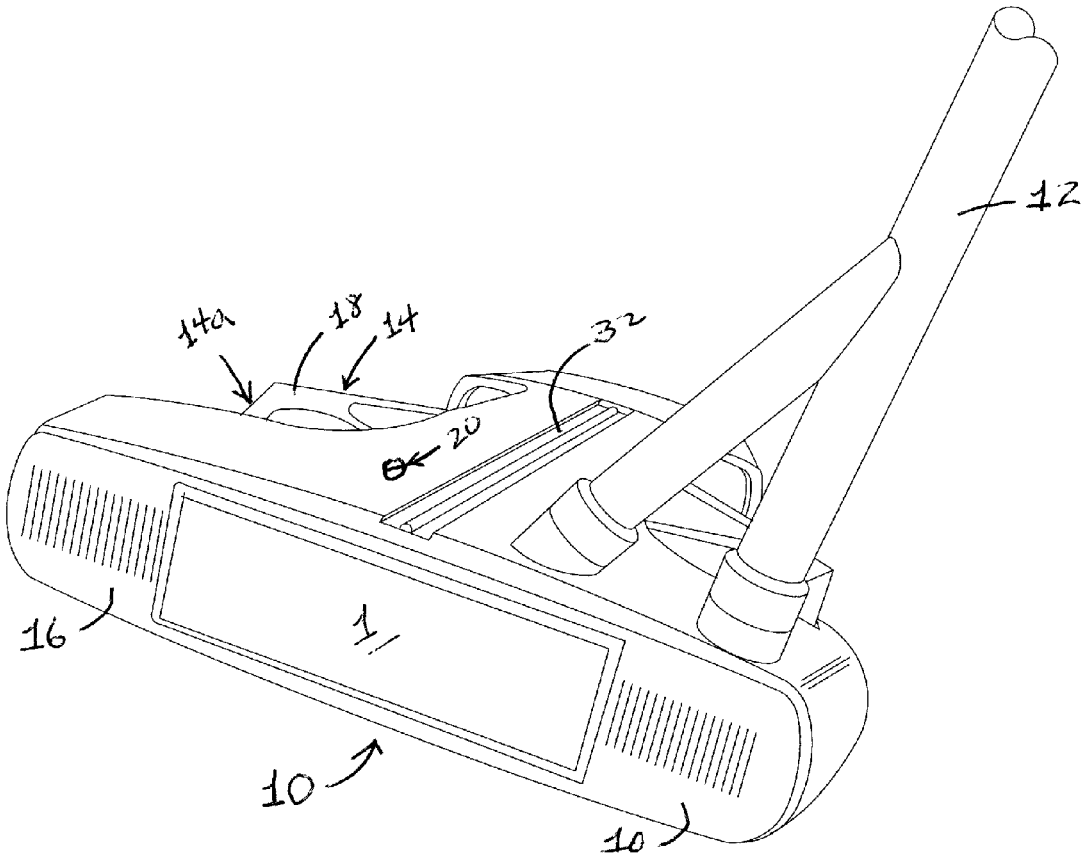
FIG. 1 is a perspective view of the club head of a golf club having the variable interface putter face apparatus of the present invention.

Turning now, in detail, to an analysis of the drawing figures, FIG. 1 is a perspective view of the club head of a golf club having the variable interface putter face apparatus 10 of the present invention affixed to the lower portion of a shaft 12 (lower portion shown) of a putter golf club. The variable interface putter face apparatus 10 is comprised of a putter face 14 on the putter portion 16 of the golf club.

Figure 2:
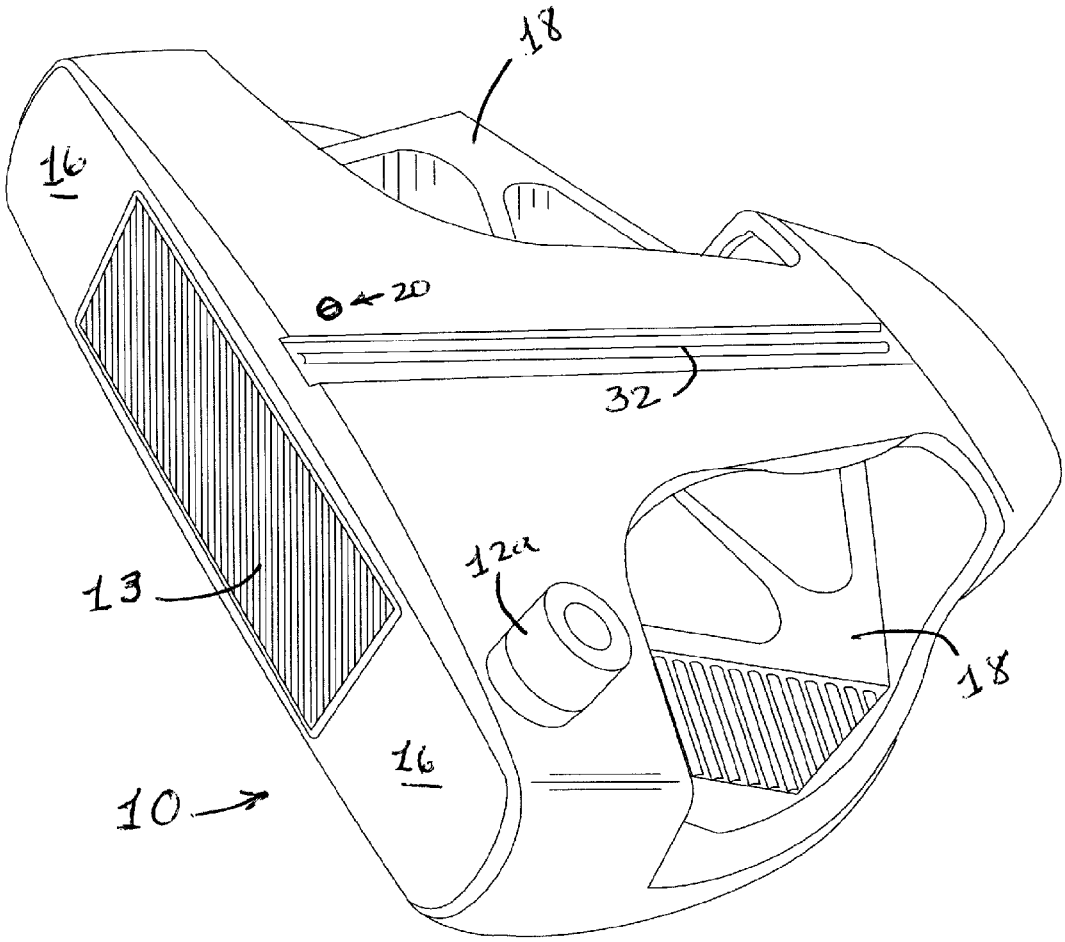
FIG. 2 is a further perspective view of the variable interface putter face apparatus of the present invention without the shaft portion of the putter golf club.
Figure 3:
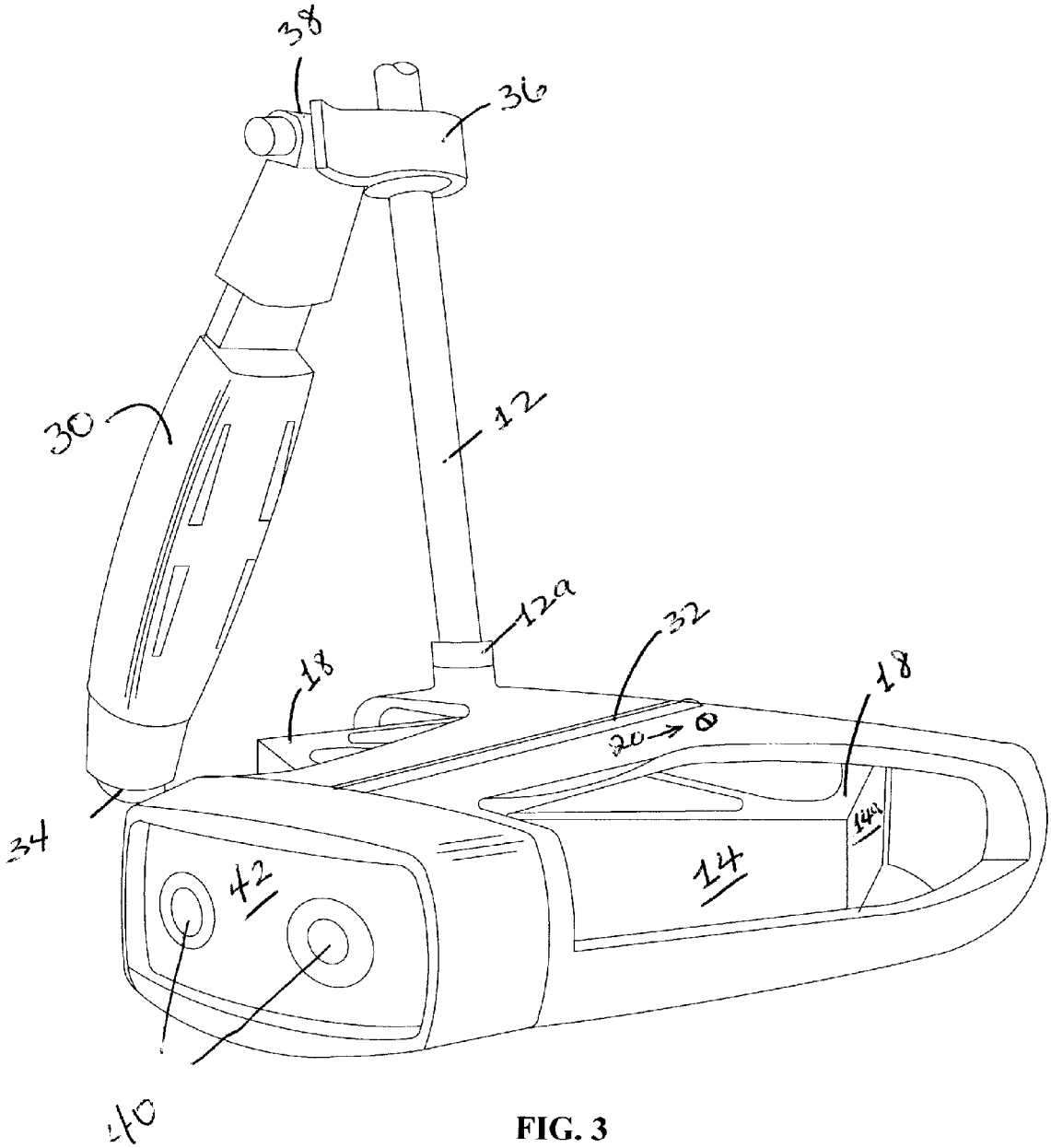
FIG. 3 is a rear perspective view of the variable interface putter face apparatus of the present invention in combination with the analyzer device of the invention being secured to the shaft of a putter golf club.

As best shown in FIGS. 2 and 3, variable interface putter face apparatus 10 includes a multi-sided, self-contained rotating carousel 18, located within the club head, which may be comprised of three or more sides—each side supporting one putter face 14, 14*a*—however, five sides, or a pentagon-shaped rotating carousel is preferred, since this shape for the carousel is understood as providing an enhanced moment of inertia, The preferred pentagon shape of the rotating carousel has been discovered to create greater stabilization at impact with the golf ball due to a higher moment of inertia, which produces a greater transfer of energy for a straighter ball path. Rotation of the carousel can either be effected manually or via an automated device which readily causes rotation. A securement screw 20 is provided in the club head for securing in place the rotating carousel 18 once the golfer has set the carousel into position wherein the desired putter face 14 selected and in place. Instead of a securement screw any alternative means that locks the rotating carouse in place, when rotation is neither intended nor desirable, would suffice. As further shown in FIG. 2, retaining means 12*a* for golf club shaft 12 are also provided.

Figure 4:
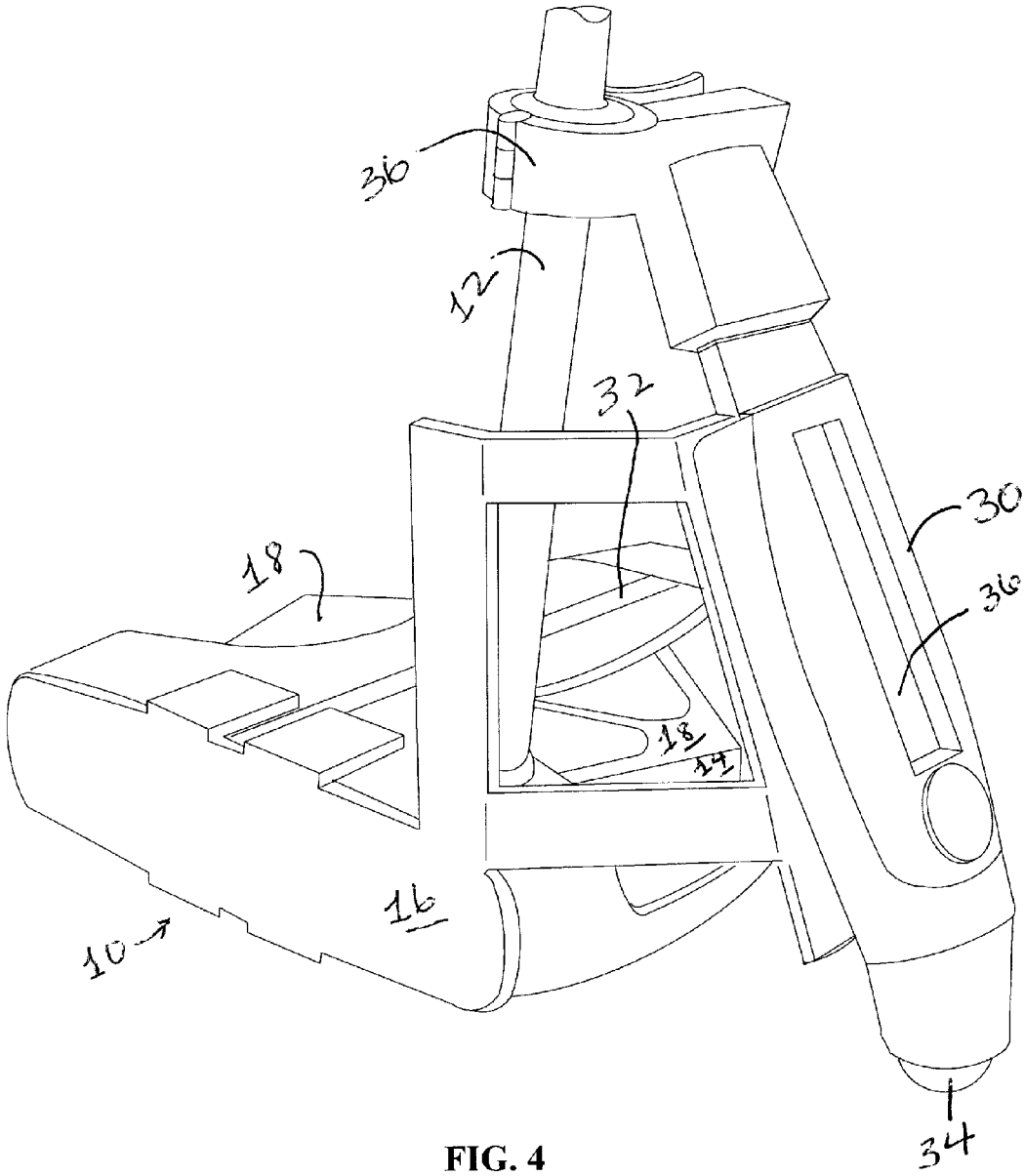
FIG. 4 is a front side perspective view of the variable interface putter face apparatus of the present invention in combination with the analyzer device of the invention being secured to the shaft of a putter golf club; and, FIG. 5 is an exploded view of a putter face within the scope of the present invention, which putter face is comprised of a plurality of layered materials.

Further illustrated in FIGS. 1 and 2 is an alignment strip 32, which is located down the center of the club head 10 and perpendicular to the face of the putter 14. Alignment strip 32 is to be used in connection with analyzing device 30, which is illustrated in FIGS. 3 and 4, and which includes selection and calibration modes for aiding the golfer in choosing the optimal putter face and aligning the putter golf club with the golf hole in view of prevailing weather and related environmental conditions of the green. The analyzing device 30 further includes data tracking ball 34, or comparable means for reading the greens, and digital display, which provides relevant data to the golfer and which is secured to shaft 12 of the golf club via an attachment clamp 36, though any suitable alternative means for securement, other than a clamp, would suffice. Between attachment clamp 36 and analyzing device 30 is an adjustable arm 38 that includes a pivot which allows the analyzing device 30 to be pivoted from a downward position, wherein the tracking ball 34 is touching the green, or in close proximity with the green, and an upward, or horizontal, position, as earlier described.

The variable interface putter face apparatus 10 of the present invention may optionally be provided with weight securing screws 40 for altering the rectangular (other alternatively shaped) weight 42 and overall feel of the putter golf club.

Figure 5:
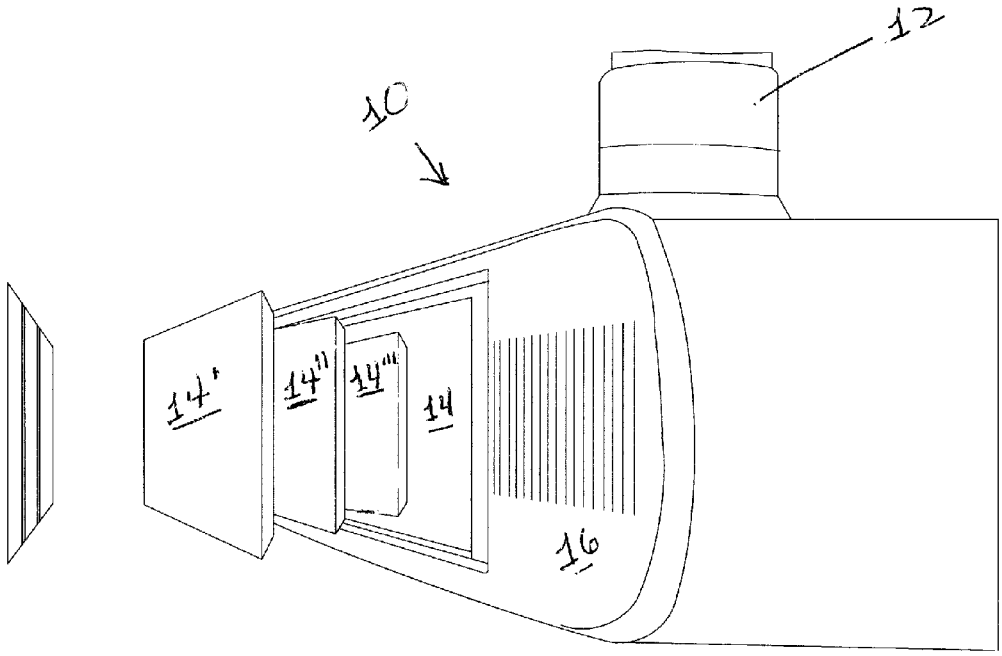

Finally, FIG. 5 presents an exploded view showing multiple layers 14', 14", 14' of golf putter face 14 with the outer layer 14' preferably being a texture layer; the middle layer 14" is preferably intended to be a shock-absorber layer; and the inner most layer 14''', preferably providing stability/refraction. The result of such a preferred putter face construction is to provide a proper redistribution of energy upon impact.

The variable interface putter golf club considered alone or in combination with the analyzer device of the present invention is primarily, but not exclusively, intended as a golf training aid and a pre-round warm-up tool for providing the golfer with technical data leading to enhanced environmental and spatial awareness. This results in improved accuracy and elevated confidence for the golfer, thereby helping the golfer to become better oriented on the putting green and overall improve his or her game.

The analyzing device of the present invention may be used with a golf putter or any other type of golf club, and may be attached to either the shaft or another part of the golf club.

While only several embodiments of the present invention have been shown and described, it will be obvious to those skilled in the art that many modifications may be made to the present invention without departing from the spirit and scope thereof.

What is claimed is:

1. A variable interface putter golf club, comprising:

a golf club having a shaft with a club head affixed to a first end of said shaft that is distal from a second end of said shaft to be gripped by a golfer;

a multi-sided rotatable carousel contained substantially within said club head of said golf club, said multi-sided rotatable carousel having a putter face on a plurality of sides of said multi-sided rotating carousel;

means for permitting rotation of said multi-sided rotatable carousel for exposing one putter face of said plurality of putter faces for allowing the golfer to putt with said one putter face exposed at a given time;

means for securing in place for preventing unwanted rotation of said multi-sided rotatable carousel so that only one putter face is exposed at a given time and that said one putter face is secured in place during play; and wherein at least one said putter face on one side of said plurality of sides of said multi-sided rotatable carousel has an outer layer being a texture layer, a middle layer being a shock absorber layer, and an innermost layer being a stability/refraction layer.

2. The variable interface putter golf club according to claim 1, wherein said multi-sided rotatable carousel has a pentagon shape for allowing up to five putter faces to be placed on said multi-sided rotatable carousel for optional use by the golfer.

3. The variable interface putter golf club according to claim 1, wherein said means for securing in place for preventing unwanted rotation of said multi-sided rotatable carousel is a securing screw.

4. The variable interface putter golf club according to claim 1, wherein said multi-sided rotatable carousel has a pentagon shape with a different putter face on each of five sides of said multi-sided rotatable carousel.

5. The variable interface putter golf club according to claim 1, wherein each said putter face on said plurality of sides of said multi-sided rotatable carousel has a different density and different texture from any other said putter face on said plurality of sides of said multi-sided rotatable carousel.

6. The variable interface putter golf club according to claim 1, wherein each said putter face on said plurality of sides of said multi-sided rotatable carousel is comprised of multiple layers of different densities and different textures.

7. A variable interface putter golf club, comprising:

a golf club having a shaft with a club head affixed to a first end of said shaft that is distal from a second end of said shaft to be gripped by a golfer;

a multi-sided rotatable carousel contained substantially within said club head of said golf club, said multi-sided rotatable carousel having a putter face on a plurality of sides of said multi-sided rotating carousel;

means for permitting rotation of said multi-sided rotatable carousel for exposing one putter face of said plurality of putter faces for allowing the golfer to putt with said one putter face exposed at a given time, said means for permitting rotation having a substantially vertically-disposed axis of rotation relative to a playing surface with said plurality of putter faces of said multi-sided rotatable carousel being substantially horizontally rotatable relative to the playing surface about said vertically-disposed axis of rotation; and, means for securing in place for preventing unwanted rotation of said multi-sided rotatable carousel so that only one putter face is exposed at a given time and that said one putter face is secured in place during play.

8. The variable interface putter golf club according to claim 7, wherein said multi-sided rotatable carousel has a pentagon shape for allowing up to five putter faces to be placed on said multi-sided rotatable carousel for optional use by the golfer.

9. The variable interface putter golf club according to claim 7, wherein said means for securing in place for preventing unwanted rotation of said multi-sided rotatable carousel is a securing screw.

10. The variable interface putter golf club according to claim 7, wherein said multi-sided rotatable carousel has a pentagon shape with a different putter face on each of five sides of said multi-sided rotatable carousel.

11. The variable interface putter golf club according to claim 7, wherein each said putter face on said plurality of sides of said multi-sided rotatable carousel has a different density and different texture from any other said putter face on said plurality of sides of said multi-sided rotatable carousel.

12. The variable interface putter golf club according to claim 7, wherein each said putter face on said plurality of sides of said multi-sided rotatable carousel is comprised of multiple layers of different densities and different textures.

13. A variable interface putter golf club, comprising:

a golf club having a shaft with a club head affixed to a first end of said shaft that is distal from a second end of said shaft to be gripped by a golfer;

a multi-sided rotatable carousel contained substantially within said club head of said golf club, said multi-sided rotatable carousel having a pentagon shape and five putter faces for allowing placement of a putter face on each putter face of said five putter faces of said multi-sided rotatable carousel for providing enhanced stabilization upon impact of one said putter face with a golf ball due to an enhanced moment of inertia;

means for permitting rotation of said multi-sided rotatable carousel for exposing one said putter face of said five putter faces for allowing the golfer to putt with said one said putter face exposed at a given time; and, means for securing in place for preventing unwanted rotation of said multi-sided rotatable carousel so that only one said putter face is exposed at a given time and that one said putter face is secured in place during play.

14. The variable interface putter golf club according to claim 13, wherein said means for securing in place for preventing unwanted rotation of said multi-sided rotatable carousel is a securing screw.

15. The variable interface putter golf club according to claim 13, wherein said multi-sided rotatable carousel has a pentagon shape with a different putter face on each of five sides of said multi-sided rotatable carousel.

16. The variable interface putter golf club according to claim 13, wherein each said putter face on said plurality of sides of said multi-sided rotatable carousel has a different density and different texture from any other said putter face on said plurality of sides of said multi-sided rotatable carousel.

17. The variable interface putter golf club according to claim 13, wherein each said putter face on said plurality of sides of said multi-sided rotatable carousel is comprised of multiple layers of different densities and different textures.

* * * * *